US012622513B2

(12) United States Patent
Spector

(10) Patent No.: US 12,622,513 B2
(45) Date of Patent: May 12, 2026

(54) CUSTOMIZABLE STORAGE APPARATUS

(71) Applicant: Max Spector, Woodmere, NY (US)

(72) Inventor: Max Spector, Woodmere, NY (US)

( * ) Notice: Subject to any disclaimer, the term of this patent is extended or adjusted under 35 U.S.C. 154(b) by 254 days.

(21) Appl. No.: 18/232,816

(22) Filed: Aug. 10, 2023

(65) Prior Publication Data

US 2025/0049209 A1 Feb. 13, 2025

(51) Int. Cl.

| | |
|---|---|
| ***A47B 47/00*** | (2006.01) |
| ***A47B 88/988*** | (2017.01) |
| *A47B 88/969* | (2017.01) |
| *A47G 21/16* | (2006.01) |

(52) U.S. Cl.

CPC ..... *A47B 47/0091* (2013.01); *A47B 88/988* (2017.01); *A47B 2088/976* (2017.01); *A47G 21/16* (2013.01)

(58) Field of Classification Search

CPC ..... A47B 47/0091; A47B 88/988; A47B 2088/976; A47G 21/16

USPC ..... 108/29

See application file for complete search history.

(56) References Cited

U.S. PATENT DOCUMENTS

| | | | | | |
|---|---|---|---|---|---|
| 2,670,085 | A | * | 2/1954 | Sorrentino | A47F 7/02 211/59.1 |
| 2,957,585 | A | * | 10/1960 | Berlener | B01L 9/00 211/74 |
| 4,364,480 | A | * | 12/1982 | Ohno | A47G 23/0208 211/202 |
| D351,745 | S | * | 10/1994 | Seifert | D6/682.6 |
| D390,727 | S | * | 2/1998 | Ferry | D6/677 |
| D420,835 | S | * | 2/2000 | Pezzullo | D6/680.2 |
| D495,880 | S | * | 9/2004 | Warren, III | D6/680 |
| D541,493 | S | * | 4/2007 | Peet | D32/8 |
| D603,657 | S | * | 11/2009 | Tu | D7/622 |
| D622,078 | S | * | 8/2010 | Stukenberg | D6/682.6 |
| 8,292,097 | B2 | * | 10/2012 | Goldberg | A47F 7/024 340/568.1 |
| D680,394 | S | * | 4/2013 | Mirza | D7/707 |
| D697,741 | S | * | 1/2014 | Musheyev | D6/677.5 |
| D700,936 | S | * | 3/2014 | Parker | D19/85 |
| D701,715 | S | * | 4/2014 | Musheyev | D6/682.6 |
| D736,323 | S | * | 8/2015 | Wai Shing | D21/419 |
| D772,619 | S | * | 11/2016 | Lombardi | D6/682.4 |
| D806,392 | S | * | 1/2018 | Glick | D3/315 |
| D839,030 | S | * | 1/2019 | Diorio | D6/677.5 |
| 10,299,611 | B1 | * | 5/2019 | O'Malley | B65D 1/34 |
| D865,454 | S | * | 11/2019 | Liu | D7/600.4 |
| D875,444 | S | * | 2/2020 | Siry | D6/677 |
| D908,409 | S | * | 1/2021 | Chiang | D6/681 |
| 11,058,238 | B1 | * | 7/2021 | Toomey | A47F 5/025 |
| D930,907 | S | * | 9/2021 | Williams | D28/93 |

(Continued)

*Primary Examiner* — Daniel J Troy
*Assistant Examiner* — Timothy M Ayres
(74) *Attorney, Agent, or Firm* — Bochner PLLC; Andrew D. Bochner

(57) ABSTRACT

The present invention relates to an apparatus for storing items. The apparatus may include a base comprising a base surface and a rim. One or more columns may be attached to the base surface. Additionally, the apparatus may include at least one central column, wherein the height of the at least one central column may be greater than the height of the one or more columns. This configuration may allow for efficient storage of items. The apparatus may provide a versatile and space-saving solution for organizing and storing various items.

20 Claims, 8 Drawing Sheets

(56) References Cited

U.S. PATENT DOCUMENTS

| | | | | |
|---|---|---|---|---|
| 11,304,498 | B2 * | 4/2022 | Duffus | A47B 45/00 |
| D994,534 | S * | 8/2023 | Singer | D11/147 |
| D1,071,624 | S * | 4/2025 | Spector | D6/682.2 |
| 2016/0262560 | A1 * | 9/2016 | Fields | A47F 7/065 |

* cited by examiner

CUSTOMIZABLE STORAGE APPARATUS

FIELD OF INVENTION

The present disclosure relates to storage devices. Specifically, devices for storing ring-structured items in an aesthetically pleasing manner.

INTRODUCTION

Various approaches have been developed for storing items in an organized and efficient manner. However, especially for oddly shaped items such as napkin rings, the solution is usually to haphazardly store the items in drawers, which is neither aesthetically pleasing nor efficient, and may even result in damage to the item. Further, such means of storage makes the items inefficient to transport.

Other approaches have attempted to address the limitations of shaped item storage by providing square cavities to house each item. However, these solutions often make it difficult to retrieve each item, which can be time-consuming and cumbersome for users, and can increase the risk of the item falling out if not kept flat. Such solutions are also often designed without aesthetics in mind, leading to an apparatus which is not pleasing to look at.

As such, none of the previous approaches have provided a comprehensive solution that combines the features described in this disclosure, such as a base with columns, to optimize storage capacity and flexibility, while providing an apparatus which has aesthetic appeal.

SUMMARY

Aspects of the present disclosure relate to an apparatus for storing items, the apparatus including: a base including a base surface and a rim; one or more columns, wherein the one or more columns are attached to the base surface; and at least one central column, wherein a height of the at least one central column is greater than a height of the one or more columns.

Aspects of the present disclosure relate to an apparatus, wherein the base is circular.

Aspects of the present disclosure relate to an apparatus, wherein the base surface is rotatable about an approximate center of the base.

Aspects of the present disclosure relate to an apparatus, wherein the one or more columns are removably attached to the base surface.

Aspects of the present disclosure relate to an apparatus, further including one or more ornaments.

Aspects of the present disclosure relate to an apparatus, wherein the one or more ornaments are permanently attached to a top surface of the one or more columns.

Aspects of the present disclosure relate to an apparatus, wherein the one or more ornaments are removably attached to a top surface of the one or more columns.

Aspects of the present disclosure relate to an apparatus, wherein the base is quadrilateral.

Aspects of the present disclosure relate to an apparatus, wherein the base is hexagonal.

Aspects of the present disclosure relate to an apparatus, wherein the base is removably attached to one or more adjacent bases.

Aspects of the present disclosure relate to an apparatus for storing items, the apparatus including: a base including a base surface and a rim; one or more columns, wherein the one or more columns are attached to the base surface; at least one central column, wherein a height of the at least one central column is greater than a height of the one or more columns; and one or more structures, wherein each of the one or more structures is disposed upon at least one of the one or more columns.

Aspects of the present disclosure relate to an apparatus, wherein the base is circular.

Aspects of the present disclosure relate to an apparatus, wherein the one or more columns are removably attached to the base surface.

Aspects of the present disclosure relate to an apparatus, further including one or more ornaments.

Aspects of the present disclosure relate to an apparatus, wherein the one or more ornaments are permanently attached to a top surface of the one or more columns.

Aspects of the present disclosure relate to an apparatus, wherein the one or more ornaments are removably attached to a top surface of the one or more columns.

Aspects of the present disclosure relate to an apparatus, wherein the base is quadrilateral.

Aspects of the present disclosure relate to an apparatus, wherein the base is hexagonal.

Aspects of the present disclosure relate to an apparatus, wherein the base is removably attached to one or more adjacent bases.

Aspects of the present disclosure relate to an apparatus for adjustable column width, the apparatus including: a structure including a frame including one or more wires; and a base including a base surface and a rim, wherein the rim extends around a circumference of the base, wherein the rim is raised perpendicularly to the base surface, and wherein the structure is disposed upon the base surface.

Additional aspects related to this disclosure are set forth, in part, in the description which follows, and, in part, will be obvious from the description, or may be learned by practice of this disclosure.

It is to be understood that both the forgoing and the following descriptions are exemplary and explanatory only and are not intended to limit the claimed disclosure or application thereof in any manner whatsoever.

BRIEF DESCRIPTION OF THE DRAWINGS

The incorporated drawings, which are incorporated in and constitute a part of this specification exemplify the aspects of the present disclosure and, together with the description, explain and illustrate principles of this disclosure.

DETAILED DESCRIPTION

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

The present disclosure may relate various embodiments of a caddy 100/200/300 for storing various items. Such items may include items having a ringed structure, such as napkin rings or any other suitable ring-structured item known to those of skill in the art.

Figure 1:
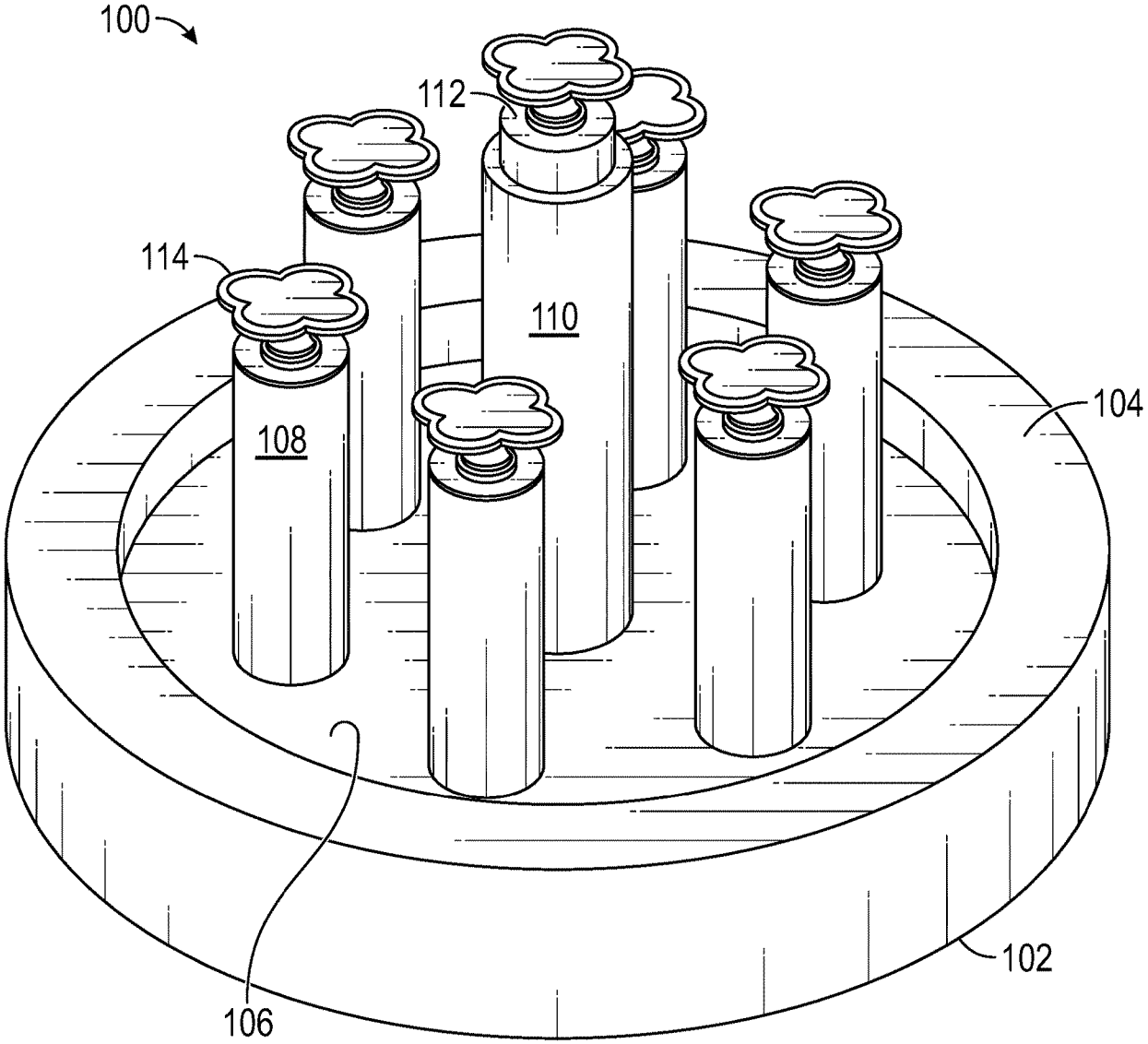
FIG. 1 illustrates an embodiment of a circular storage device according to various aspects of the present disclosure.

Starting with FIG. 1, the present disclosure may relate to various embodiments of a circular caddy 100. The circular caddy 100 may include a base 102, a rim 104, a base surface 106, one or more columns 108, a central column 110, a staging portion 112, and/or one or more ornaments 114.

The base 102 may include a base surface 106 and a rim 104. The base 102 may be constructed using a variety of materials including stone, wood, metal, glass, enamel, and/or plastic. In an embodiment, the base 102 is constructed from powdered glass. In another embodiment, the base surface 106 may occupy an upper surface of the base 102 and may be defined by the rim 104 (discussed in further detail below). In an embodiment, the base 102 is circular. However, as disclosed in further detail herein, the base 102 may be any suitable shape such as quadrilateral, hexagonal, triangular, etc.

The size of the base 102 may be adjusted depending on the number of columns 108 (discussed in further detail below) desired. For example, the base 102 may be sized to accommodate at least six columns 108 and one central column 110 upon the base surface 106.

The base surface 106 may include an area upon which one or more columns 108 and/or a central column 110 may be affixed. In an embodiment, the base surface 106 may include a plain surface. In another embodiment, a pattern may be affixed to the base surface 106 to provide desired aesthetic properties. As a non-limiting example, the base surface 106 may include a geometric pattern, such as a zig-zag or striped pattern. In an embodiment, the base surface 106 includes a graphic including butterfly, or other animal shapes. As another non-limiting example, the base surface 106 may include an image, such as a photograph or Computer-Generated Image ("CGI"). The pattern or image may be affixed to the base surface 106 via direct printing, applying a vinyl decal, or by any other attachment means known to those of skill in the art.

The base 102 may include a rim 104 which may prevent items from falling off the base 102 and/or may provide the functionality of allowing items to be stored within the boundary defined by the rim 104 and base surface 106. In such an embodiment, the rim 104 may be disposed about a perimeter of the base surface 106.

The rim 104 may be any suitable width or height. As such, the width of the rim 104 may be adjusted depending on the desired aesthetic of the base 102 and/or the desired surface area of the base surface 106. In an embodiment, the width of the rim 104 may be adjusted depending on the number of desired columns 108. For example, if the circular caddy 100 includes just one column 108, then either the surface area of the base surface 106 may be decreased, or the width of the rim 104 increased to reduce the amount of unoccupied area on the base surface 106. In an embodiment, the rim 104 may include one or more handles attached to it to allow for easy transportation of the caddy 100/200/300.

The rim 104 may be integral to the base 102. In another embodiment, the rim 104 may be removably attached. As a non-limiting example, the rim 104 may removably attach to the base surface 106 via one or more magnets. However, other means for attachment may be used, such as hook and loop or one or more removeable joints. In such an embodiment, the rim 104 may be removed depending upon the desired aesthetics or functionality of the base 102.

The base 102 may rotate to allow for easy access of each of the one or more columns 108. In such an embodiment, the base 102 may include a rotation mechanism. The rotation mechanism may include a series of roller ball bearings positioner around a circumference of the base 102. Such roller ball bearings may be affixed to an underside of the base 102 and may interface directly with a surface the circular caddy 100 is placed upon.

In an embodiment, the base 102 includes a layer (not shown) abutting the underside of the base 102. The layer may comprise the same material as the base 102 or may comprise a different material. As a non-limiting example, the layer may include one or more grooves configured to interface with the rotation mechanism by controlling the path of travel of the rotation mechanism when in use. In such an embodiment, when in motion, rotation about an approximate center of the circular caddy 100 may be achieved by the roller ball bearings traveling along the groove provided by the layer.

In another embodiment, the base surface 106 may be a layer having one or more roller ball bearings attached to its underside. In such an embodiment, the base surface 106 may be loosely placed within the boundary defined by an inner circumference of the rim 104. As such, the rim 104 may control the base surface's 106 path of rotation by preventing unwanted lateral movement.

Figure 2:
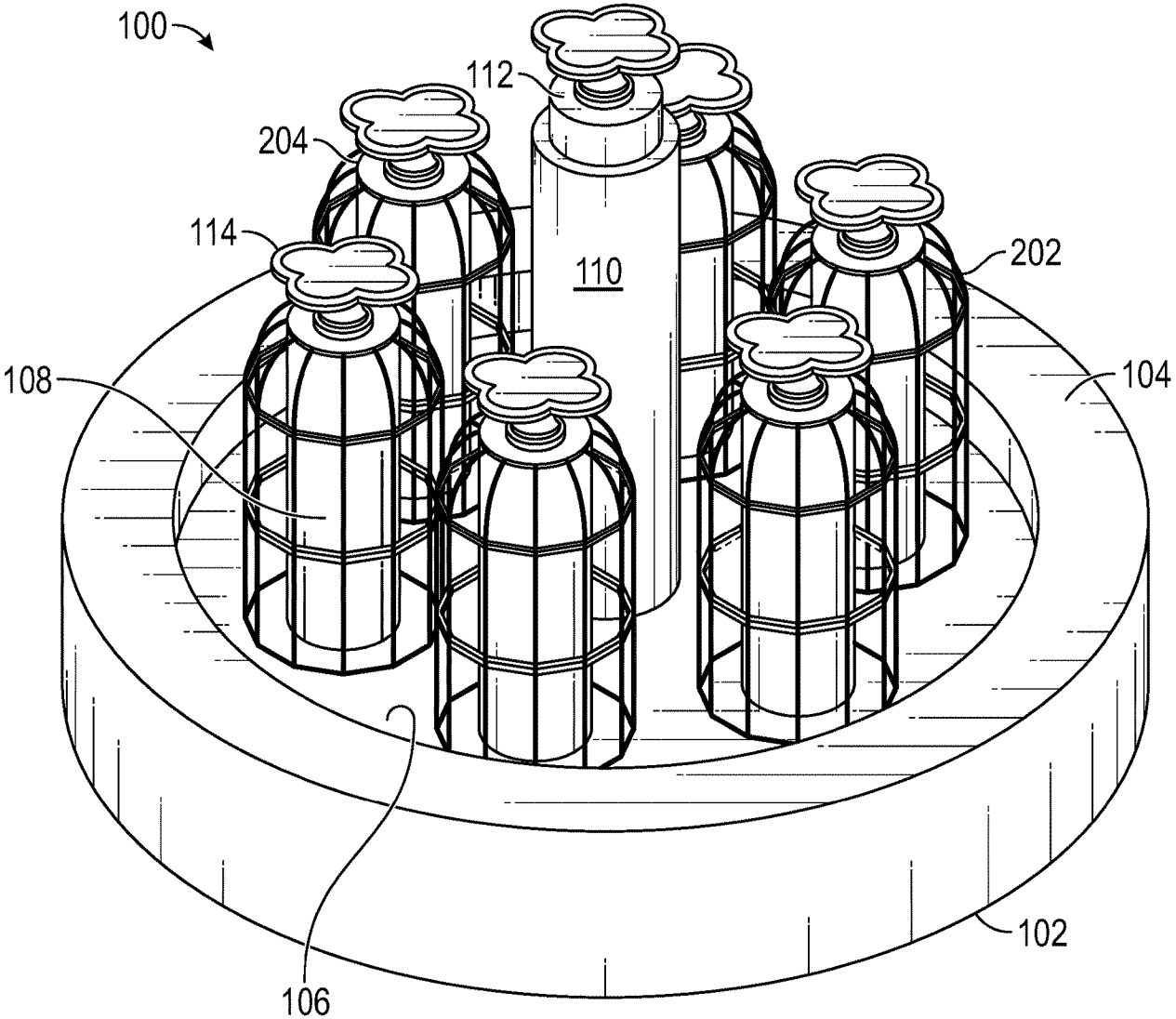
FIG. 2 illustrates another embodiment of a circular storage device according to various aspects of the present disclosure.

As previously mentioned, the base surface 106 may include one or more columns 108 and or central column 110 disposed upon it. Such columns 108/110 may be used to store ring-structured items, such as napkin rings, placed upon them. In an embodiment, the base surface 106 may have six columns 108 disposed upon its upper surface as illustrated in FIGS. 1-2. However, any suitable quantity of columns 108/110 may be used depending on the desired use of the circular caddy 100.

The one or more columns 108 and/or central column 110 may be affixed to the base surface 106 via a variety of different attachment means and may be either permanently or removably attached. For example, the one or more columns 108 and/or central column 110 may be permanently attached to the base surface 106 via one or more of adhesive or screws. As another non-limiting example, the one or more columns 108 and/or central column 110 may be removably attached to the base surface 106 via one or more magnets, hook and loop fasteners, or joints. In an embodiment, the base surface 106 and columns 108 and/or central column 110 are unibody. For example, the base surface 106 and columns 108 and/or central column 110 may be constructed from a single mold.

The width of each column 108/110 may also be customized depending upon the desired properties of the circular caddy 100. For example, the width of each column 108/110 may be configured to be slightly less than the diameter of a corresponding ring-structured item to be placed upon it. In an embodiment, each column 108 has the same width. However, in another embodiment, each column 108 may have varying widths to accommodate a plurality of items having varying diameters. For example, a certain number of columns 108 may include a width to accommodate items having a first diameter, and varying quantities of columns 108 may include a width to accommodate items having a second and subsequent diameter(s). In an embodiment in which the columns 108/110 are removably attached, the widths of each column may be customized to match the user's specific needs. In an embodiment, the width of each column 108 is approximately 2 inches.

In an embodiment, the central column 110 may have a height that is greater than its surrounding one or more columns 108. Such an embodiment may allow a user to easily pick up the caddy 100/200/300.

Each column 108/110 may include one or more ornaments 114. In an embodiment the one or more ornaments 114 may be attached to a top surface of each of the one or more columns 108 and/or central column 110. The design of each of the one or more ornaments 114 may be customized depending on the desired aesthetics of the circular caddy 100. For example, and as exemplified in FIGS. 1-7, the one or more ornaments 114 may include a clover-shaped design, gem design, and/or hexagonal design. Additional designs may include heart, square, or circular designs. However, any suitable design is contemplated as known to those of skill in the art.

Each of the one or more ornaments 114 may be permanently or removably attached. In an embodiment in which the one or more ornaments 114 are removably attached, the one or more ornaments 114 may include one or more magnets enclosed within a base of each ornament 114. To allow the one or more ornaments 114 to attach to their respective columns 108/110, each column 108/110 may include a magnetic material to attract the magnets contained within each of the one or more ornaments 114. In an embodiment, the magnets may be contained within the columns 108/110 instead of the one or more ornaments 114, and the one or more ornaments 114 may include a magnetic material. It is further contemplated that the one or more ornaments 114 may be removably attached via other attachment means such at hook and loop, or male and female threading. In an embodiment, the central column 110 may include a staging portion 112 to which at least one of the one or more ornaments 114 may be attached by the means disclosed herein.

Removably attached ornaments provide the advantage of adding further customizability to the caddy 100/200/300. For example, a user may mix and match the one or more ornaments 114 to obtain an appearance that is desirable to that user. In an embodiment in which the one or more ornaments 114 are permanently fixed to each column 108/110, the same customizability may be achieved by swapping out the entire column 108/110 as described above.

Turning to FIG. 2, the caddy 100/200/300 may include a structure 202. The structure 202 may enable the user to further aesthetically customize the caddy 100/200/300 and increase the width of each of the one or more columns 108/110 without the need to swap the entire column 108/110. Additionally, the structure 202 may be used in place of the columns 108/110, as discussed in further detail below.

The structure 202 may have a height approximately equal to the height of its corresponding column 108/110. However, in an embodiment, the structure 202 may have a height that is less than its corresponding column 108/110. As exemplified in FIGS. 2, 4, and 6-7, each structure 202 may be disposed over a corresponding column 108/110. In such an embodiment each the structure 202 may include an opening 204. To allow the structure 202 to be placed over its corresponding column 108/110, the opening 204 may have a diameter which is marginally greater than the diameter of its corresponding column 108/110, allowing a diameter of the corresponding column 108/110 to be accommodated within the opening 204. As a non-limiting example, the interface between the opening 204 and the corresponding column 108/110 keeps the structure 202 from moving around when in use.

In an embodiment the structure 202 includes a plate member (not shown) which occupies the area of the opening. In such an embodiment, the plate member may be magnetic and may interface with the columns 108/110 and/or the one or more ornaments 114 using the same attachment means described herein between the one or more ornaments 114 and the columns 108/110. It is contemplated that the plate member may attach to the columns 108/110 and/or the one or more ornaments 114 using attachment means other than magnetic attachment, such as hook and loop or male and female threading.

The structure 202 may be constructed from a variety of materials including metal wire, plastic, and/or wood. The structure 202 may take any suitable form, such as a shaped frame structure. For example, the structure 202 may embody a bird-cage style design as exemplified in FIGS. 2, 4, and 6-7. However, other designs are contemplated as understood by those of skill in the art.

In an embodiment, the structure 202 may be used in place of one or more columns 108/110. In such an embodiment, one or more structures 202 may be positioned in similar locations as the columns 108/110 and using similar attachment means as described herein. In another embodiment, the base surface 106 may include one or more grooves configured to accommodate one or more corresponding structures 202. For example, each groove may be configured to match the shape of a bottom surface of the corresponding structure 202. As such, the groove may prevent the structure 202 from sliding around the base surface 106. In an embodiment, the structure 202 is screwed into the base surface 106.

The shape of the structure 202 may be configured to provide a width to accommodate a ring-structured item, such as one or more napkin rings, to be placed upon it. As such, in a situation where the width of the columns 108/110 is substantially less than the diameter of the item to be placed upon, a user may use one or more structures 202 to effectively increase the width of each column 108/110 to better accommodate the item being placed upon it.

In an embodiment, the one or more ornaments 114 are attached to each structure 202. In such an embodiment, the structure 202 may be easily removed by grabbing the ornament 114 and lifting it to remove both the ornament 114 and structure 202.

Figure 3:
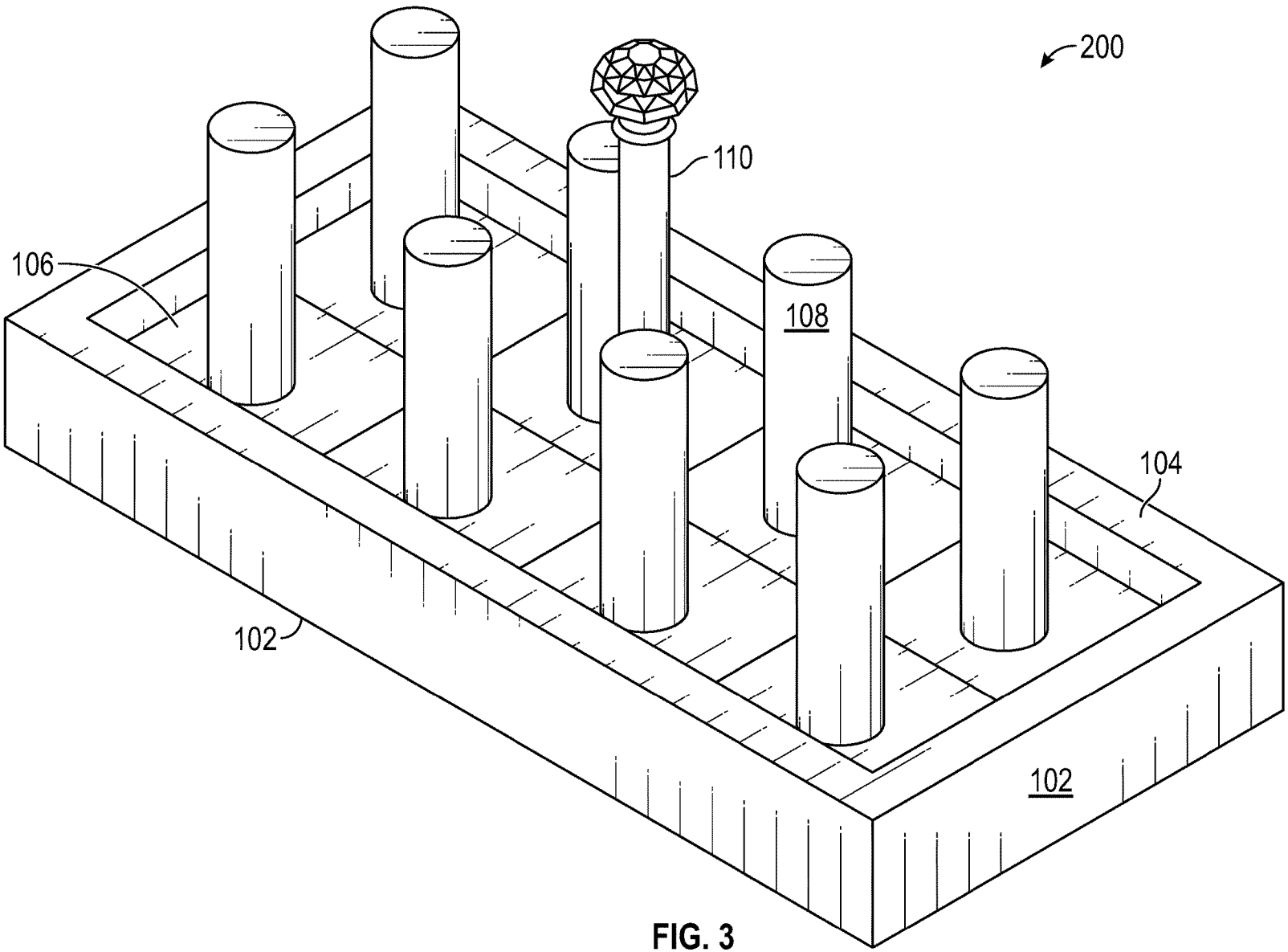
FIG. 3 illustrates an embodiment of a quadrilateral storage device according to various aspects of the present disclosure.
Figure 4:
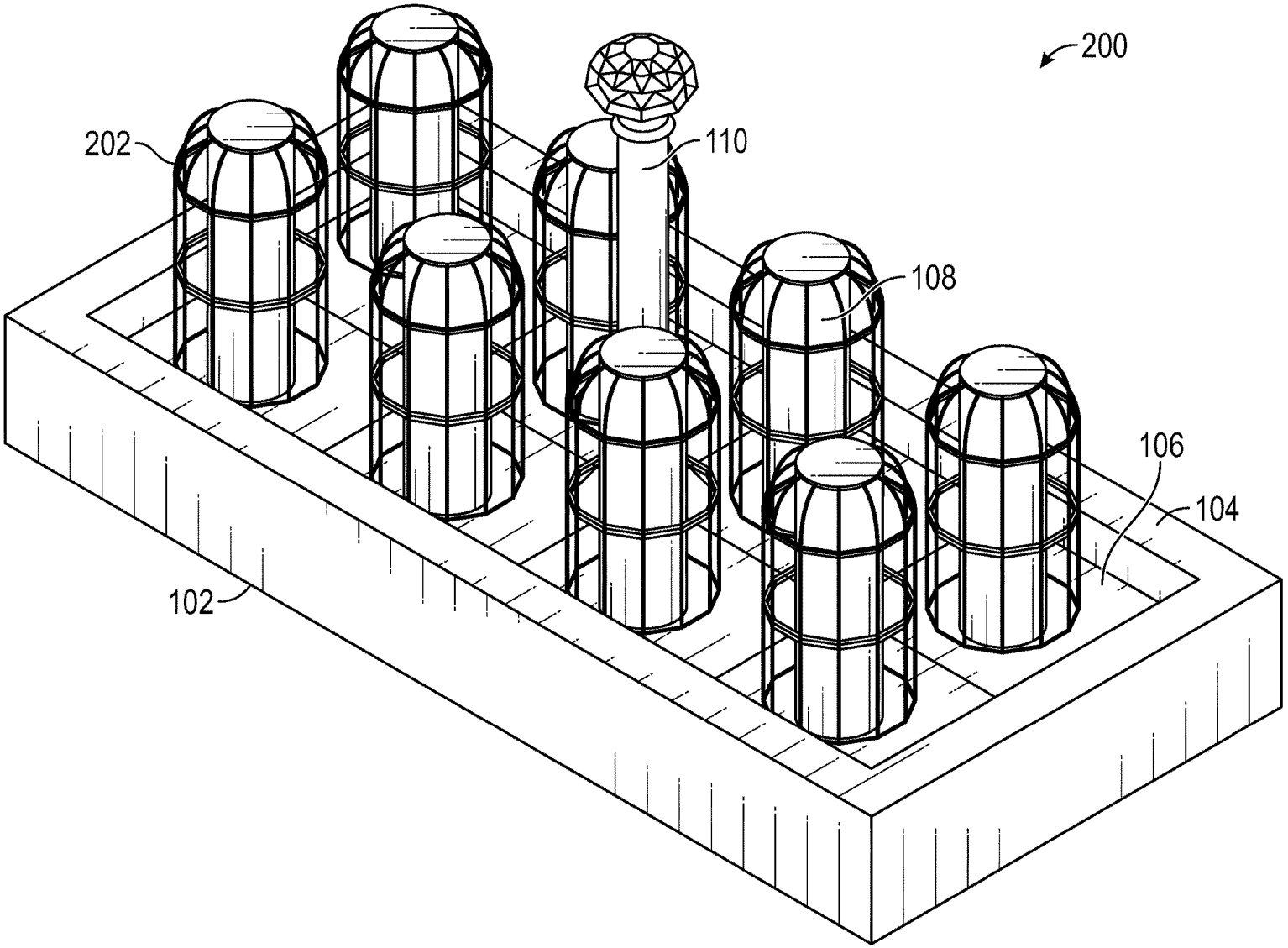
FIG. 4 illustrates another embodiment of a quadrilateral storage device according to various aspects of the present disclosure.

Turning to FIGS. 3-4, the present disclosure may relate to a quadrilateral caddy 200. In such an embodiment, the base 102 may include a quadrilateral shape. The one or more columns 108 of the quadrilateral caddy 200 may be formed into distinct rows. However, the one or more columns 108 may be arranged in any suitable configuration.

As exemplified in FIGS. 3-4, and as discussed above, the central column 110 may be a greater height than the surrounding one or more columns 108 to enable a user to easily pick up the caddy 100/200/300.

In an embodiment, and as illustrated in FIGS. 3-4, the caddy 100/200/300 may include a plurality of base surfaces 106. Each base surface 106 may allow for increased customizability by including a different design/pattern.

Each base surface 106 may be separable from its adjacent column 108 or may be permanently affixed thereto. In either embodiment, each base surface 106 may be removeable from the base 102 and swapped out by removing the base surface 106 with or without the column 108 and replacing it.

Figure 5:
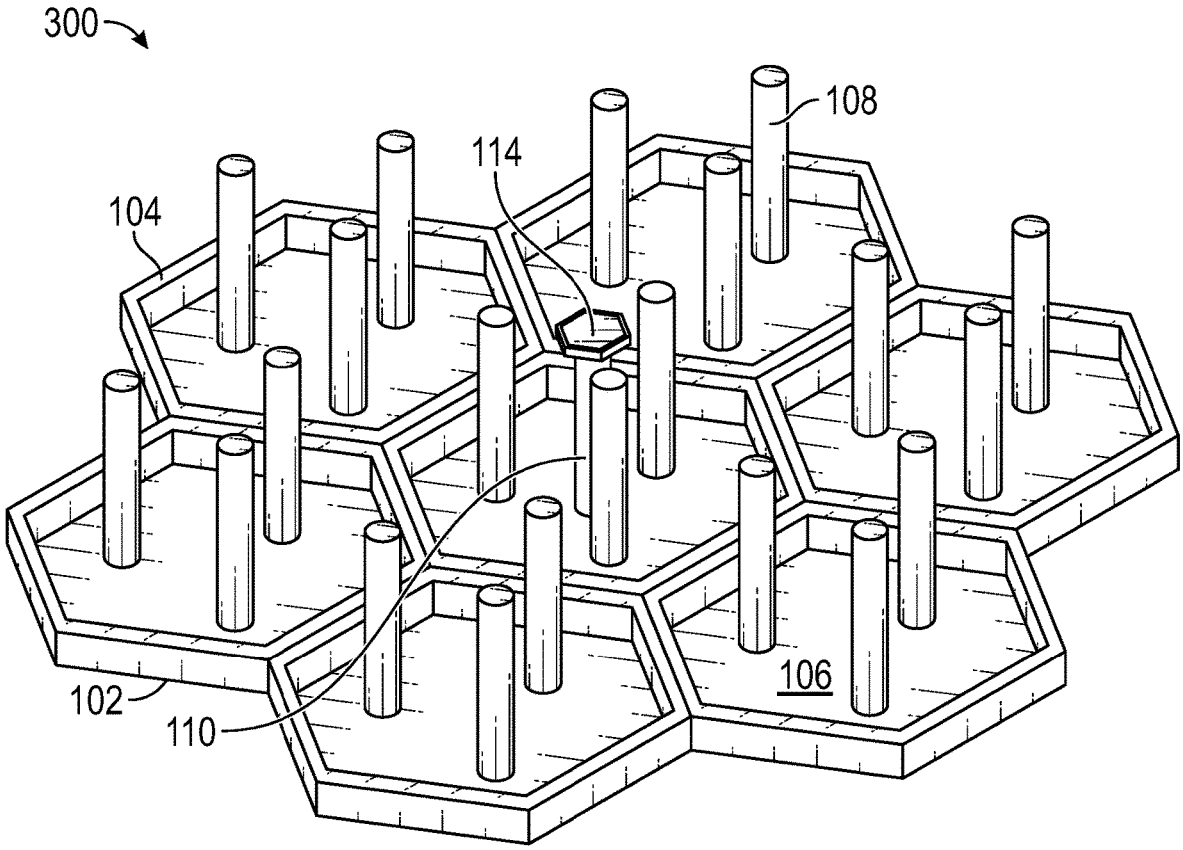
FIG. 5 illustrates an exemplary embodiment of a plurality of storage devices according to various aspects of the present disclosure.
Figure 6:
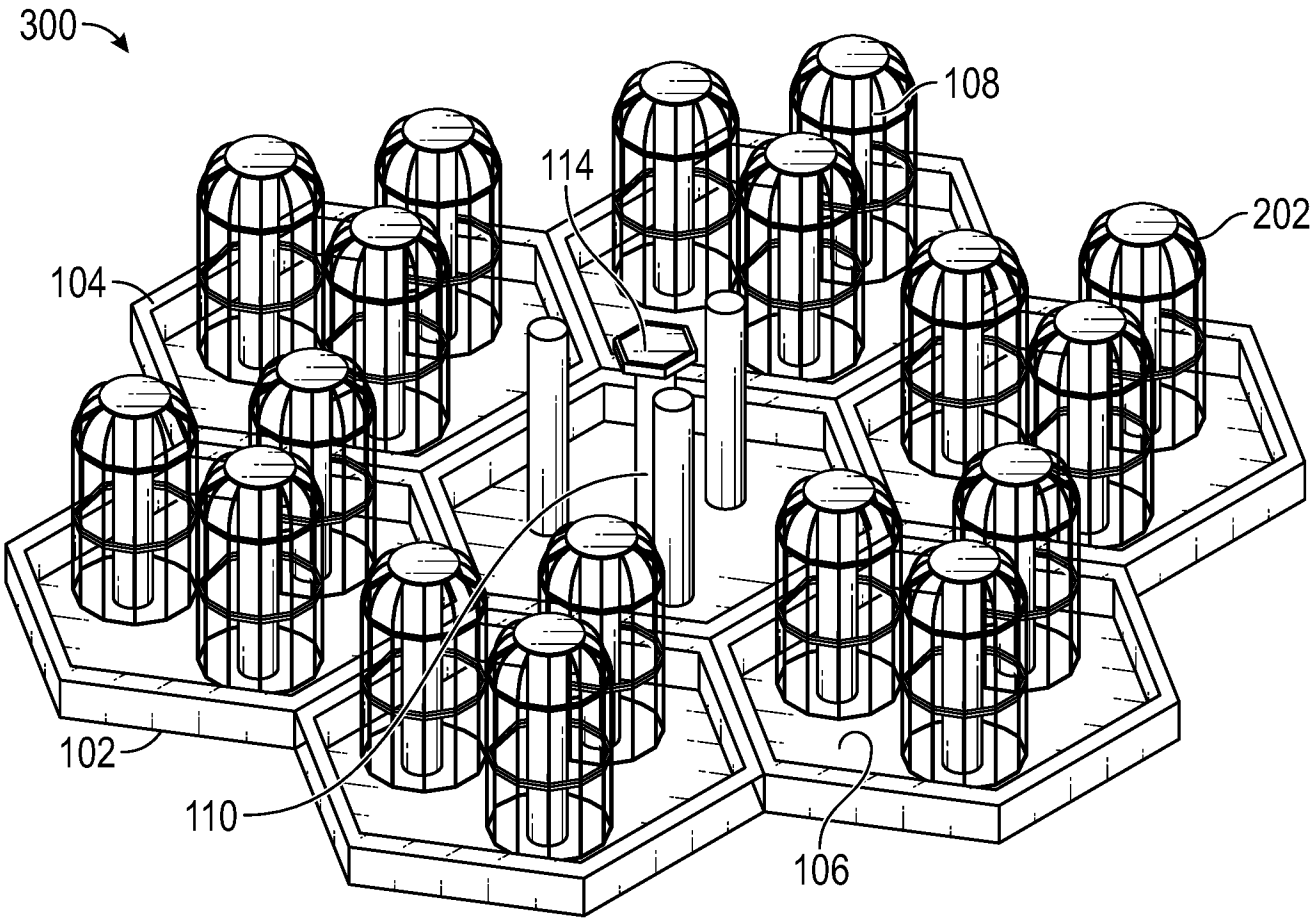
FIG. 6 illustrates another embodiment of a plurality of storage devices according to various aspects of the present disclosure.
Figure 7:
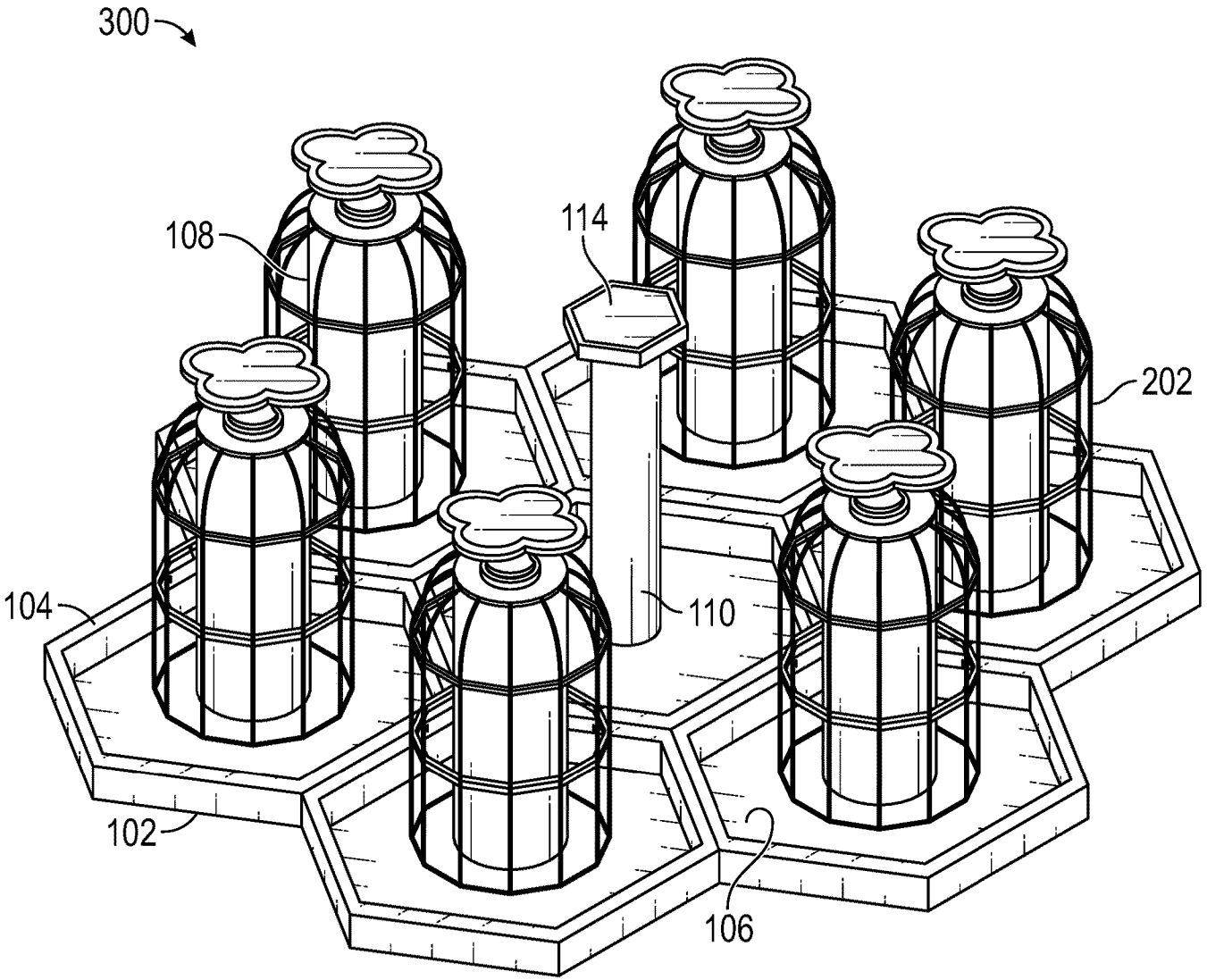
FIG. 7 illustrates another embodiment of a plurality of storage devices according to various aspects of the present disclosure.

Turning to FIGS. 5-7, the present disclosure may relate to a hexagonal caddy 300. As exemplified in in FIGS. 5-7, there may be a plurality of hexagonal caddies 300 positioned adjacent to one another as shown to achieve modular functionality. In such an embodiment, each base 102 may be removably attached to neighboring bases 102 via the various attachment means discussed herein, such as via one or more magnets disposed within the rim 104 of each caddy 300. It is contemplated that the same modularity may be achieved using the same techniques for the circular caddy 100, quadrilateral caddy 200, or other caddies embodying forms as contemplated herein.

In an embodiment, each hexagonal caddy 300 may include a plurality of columns 108 and/or central column 110. In such an embodiment, each caddy's 300 columns 108 may be configured to have a ring-structured item placed around the perimeter of the plurality of columns 108, placed around each column 108 individually, or within an interior space defined by the plurality of columns 108. Each column 108 may include a structure 202, as described herein, and as shown in FIG. 6.

FIG. 7 shows an embodiment of the hexagonal caddies 300 in which each caddy includes a single column 108. In such an embodiment, each column may be sized to accommodate a ring-structured item around it individually.

In a modular formation, the central hexagonal caddy 300 may be configured to include a single central column 110. In such an embodiment, lifting the central column 110 will allow a user to lift the hexagonal caddy 300 as well as all adjacently attached hexagonal caddies 300. The central hexagonal caddy 300 may also be utilized as a standalone caddy. For example, the central column 110 may be used to hold one or more items.

Figure 8:
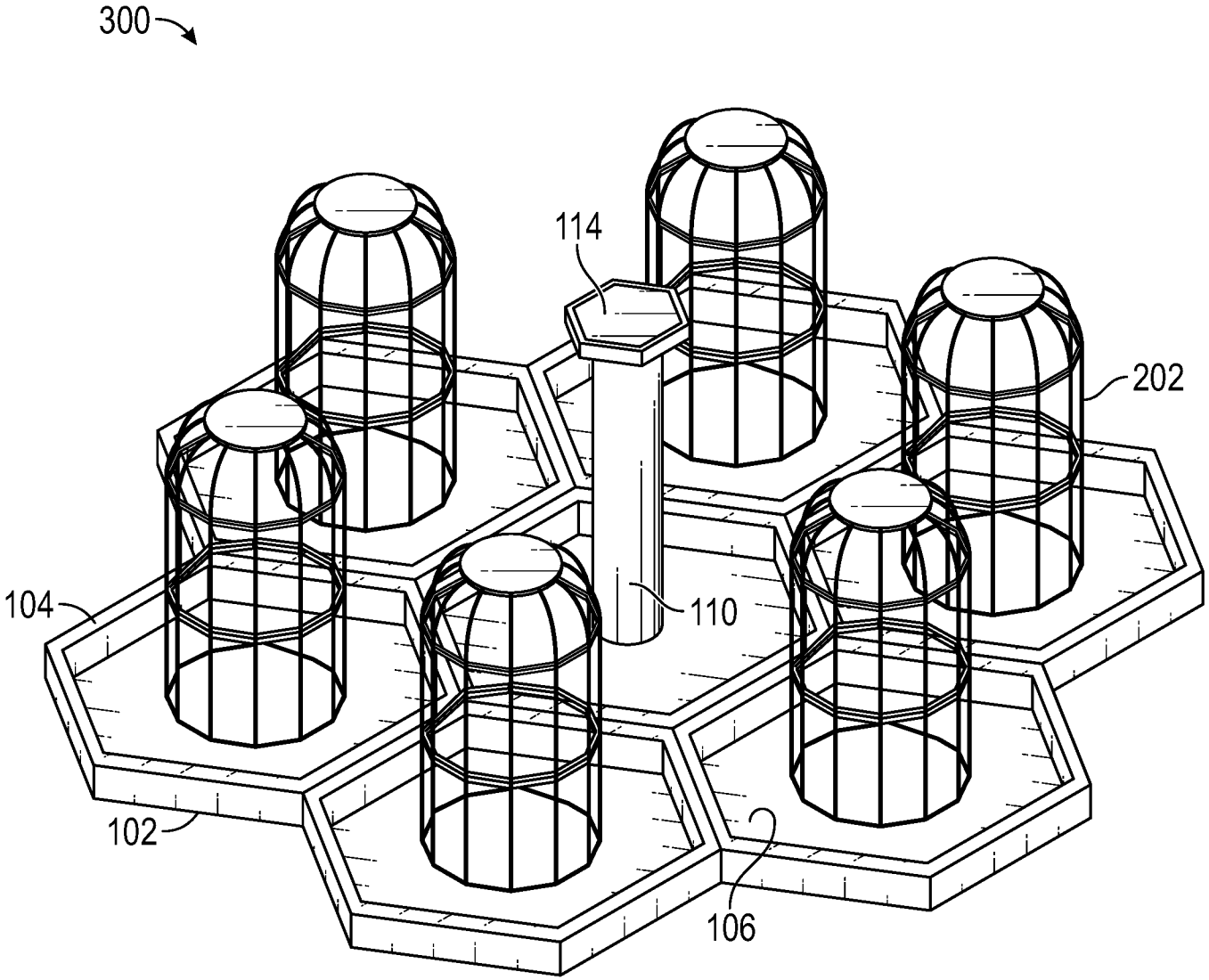
FIG. 8 illustrates another embodiment of a plurality of storage devices according to various aspects of the present disclosure.

Turning to FIG. 8, in an embodiment, the caddy 100/200/300 may not include any columns 108. In such an embodiment, the caddy 100/200/300 may include a plurality of structures 202 in place of the columns 108. In another embodiment, there may be a combination of columns 108, just structures 202, and/or columns 108 with structures 202.

It is contemplated that the various functions of each caddy 100/200/300 may be implemented across to other caddy 100/200/300 embodiments. For example, the columns 108 of caddies 100/200 may be configured to allow a ring-structured item to be placed around the perimeter of the plurality of columns 108 or placed around each column 108 individually.

Finally, other implementations of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. An apparatus for storing items, the apparatus comprising:

a base including a base surface and a rim;

one or more columns, wherein the one or more columns are attached to the base surface, and wherein the one or more columns includes at least one central column;

and a plurality of structures, each of the one or more structures including a top segment, a bottom segment, and a plurality of elongated members traversing a length between the top and bottom segments, wherein the top segment defines a top aperture, and the bottom segment defines a bottom aperture, wherein the bottom aperture abuts the base, wherein at least half of a length of each of the elongated members is approximately straight, wherein each of the one or more structures is disposed upon at least one of the one or more columns, and wherein a height of the at least one central column is greater than a height of the one or more structures.

2. The apparatus of claim 1, wherein the base is circular.

3. The apparatus of claim 2, wherein the base surface is rotatable about an approximate center of the base.

4. The apparatus of claim 1, wherein the one or more columns are removably attached to the base surface.

5. The apparatus of claim 1, further including one or more ornaments.

6. The apparatus of claim 5, wherein the one or more ornaments are permanently attached to a top surface of the one or more columns.

7. The apparatus of claim 5, wherein the one or more ornaments are removably attached to a top surface of the one or more columns.

8. The apparatus of claim 1, wherein the base is quadrilateral.

9. The apparatus of claim 1, wherein the base is hexagonal.

10. The apparatus of claim 9, wherein the base is removably attached to one or more adjacent bases.

11. An apparatus for storing items, the apparatus comprising:

a base including a base surface and a rim;

one or more columns, wherein the one or more columns are attached to the base surface, and wherein the one or more columns includes at least one central column;

and one or more structures, each of the one or more structures including a top segment, a bottom segment, and a plurality of elongated members traversing a length between the top and bottom segments, wherein the top segment defines a top aperture, and the bottom segment defines a bottom aperture, wherein each of the plurality of elongated members are mechanically joined to one another via a plurality of ring members disposed along at least each of the circumference of the top aperture and the circumference of the bottom aperture, wherein the bottom aperture abuts the base, wherein at least half of a length of each of the elongated members is approximately straight, and wherein a height of the at least one central column is greater than a height of the one or more structures.

12. The apparatus of claim 11, wherein the base is circular.

13. The apparatus of claim 11, wherein the one or more columns are removably attached to the base surface.

14. The apparatus of claim 11, further including one or more ornaments.

15. The apparatus of claim 14, wherein the one or more ornaments are permanently attached to a top surface of the one or more columns.

16. The apparatus of claim 14, wherein the one or more ornaments are removably attached to a top surface of the one or more columns.

17. The apparatus of claim 11, wherein the base is quadrilateral.

18. The apparatus of claim 11, wherein the base is hexagonal.

19. The apparatus of claim 18, wherein the base is removably attached to one or more adjacent bases.

20. An apparatus for adjustable column width, the apparatus comprising:

At least one structure including a frame including one or more wires, each structure including a top segment and a bottom segment, wherein the one or more wires traverse a length between the top and bottom segments, wherein the top segment defines a top aperture, and the bottom segment defines a bottom aperture, wherein the one or more wires are mechanically joined via a plurality of ring members disposed along at least each of the circumference of the top aperture and the circumference of the bottom aperture, wherein at least half of a length of each of the one or more wires is approximately straight; and a base including a base surface and a rim, wherein the rim extends around a circumference of the base, wherein the rim is raised perpendicularly to the base surface, wherein the bottom aperture abuts the base, and wherein the structure is disposed upon the base surface.

* * * * *